United States Patent [19]

Peterson et al.

[11] Patent Number: 5,055,962

[45] Date of Patent: Oct. 8, 1991

[54] RELAY ACTUATION CIRCUITRY

[75] Inventors: Gregory A. Peterson, South Barrington; Timothy Graff, Palatine, both of Ill.

[73] Assignee: Digital Appliance Controls, Inc., Elgin, Ill.

[21] Appl. No.: 313,637

[22] Filed: Feb. 21, 1989

[51] Int. Cl.[5] ..... H01H 47/00

[52] U.S. Cl. ..... 361/187; 307/85; 307/139; 361/7

[58] Field of Search ..... 361/2, 3, 4, 5, 6, 7, 361/152, 153, 160, 170, 185, 186, 187; 307/85, 86, 87, 112, 139, 140

[56] References Cited

U.S. PATENT DOCUMENTS

| | | | |
|---|---|---|---|
| 3,390,275 | 6/1968 | Baker | 307/64 |
| 3,557,381 | 1/1971 | Henry | 361/6 |
| 3,600,657 | 8/1971 | Pfaff et al. | 323/244 |
| 3,965,398 | 6/1976 | Miller | 361/198 |
| 4,090,228 | 5/1978 | Lupatin | 361/86 |
| 4,153,922 | 5/1979 | Azuma et al. | 361/185 |
| 4,204,149 | 5/1980 | Cleary et al. | 307/141.4 |
| 4,218,648 | 8/1980 | Sansum | 323/235 |
| 4,245,184 | 1/1981 | Billings et al. | 323/235 |
| 4,317,056 | 2/1982 | Alberts | 307/130 |
| 4,336,464 | 6/1982 | Weber | 307/141.4 |
| 4,338,562 | 7/1982 | Terwilliger | 323/323 |
| 4,357,545 | 11/1982 | LeGrand et al. | 307/64 |
| 4,420,694 | 12/1983 | Yokota et al. | 307/130 |
| 4,420,784 | 12/1983 | Chen et al. | 361/7 |
| 4,745,515 | 5/1988 | Fowler | 361/185 |
| 4,767,944 | 8/1988 | Takeuchi et al. | 361/7 |

*Primary Examiner*—A. D. Pellinen
*Assistant Examiner*—Jeffey A. Gaffin
*Attorney, Agent, or Firm*—Buchanan Ingersoll; George Patrick Baier

[57] ABSTRACT

The operation of an electromechanical relay is synchronized with the power line waveform where an electrical power supply is supplied from a source to an electrical load. The current voltage supplied to the load is characterized by a power line waveform. An electromechanical relay is positioned between the power supply and the load where contacts of the relay are opened and closed to interrupt and supply power to the load. A microcontroller is positioned between a power source and the electromechanical relay and actuates the relay so that the contacts are closed or opened at a preselected point on the power line waveform. Closure of the contacts at the preselected point is accelerated by supplying an increased power signal to the relay coil and thereafter returning the signal to the rated power.

18 Claims, 6 Drawing Sheets

RELAY ACTUATION CIRCUITRY

BACKGROUND OF THE INVENTION

1. Field of the Invention

This invention relates to method and apparatus for controlling the operation of an electromechanical relay and more particularly to circuitry for synchronizing the operation of an electromechanical relay with the supply of A.C. power to the load of an appliance.

2. Description of the Prior Art

In the operation of electrical household appliances, such as microwave ovens, dishwashers, and the like, electromechanical relays are utilized to connect and disconnect the load to a power source. The relays must be turned on and off at specific intervals to control the various appliance functions. It is known in the operation of microwave ovens to utilize a triac to control the flow of power from the source to the magnetron transformer. Unlike a relay, the turn on time of a triac is negligible, and little or no compensation is required in the timing of actuation of the triac to provide power to the magnetron at a specific point in the A.C. voltage waveform.

The utilization of a triac requires the incorporation of a heat sink and an optocoupler which substantially increases the cost of the solid state control circuitry. However, the utilization of a triac is preferred over a conventional electromechanical relay because of timing differences between relays and of changes which occur in the timing of the opening and closing of relay contacts over the life of the relay.

If the operation of the relay is not synchronized to the voltage waveform, then the relay contacts will open or close at random points in the power line waveform If the relay is operated to open the contacts to break the load current and sufficient line voltage potential is present, a high temperature electrical arc forms between the relay contacts. Arcing causes contact erosion where the contact is destroyed, reducing the service life of the relay. U.S. Pat. No. 3,600,657 discloses phase shift circuitry for controlling the point on the voltage wave when current is applied to the load.

The synchronization of the relay operation with the waveform is dependent on the time interval required for closure of the relay, known as the pull-in time. Due to timing variations between different relays and over the life of a relay, it is not uncommon for contact breaking or closure to occur at other than the desired points on the power line waveform, for example, other than at the waveform crest in the switching of the magnetron transformer of a microwave oven. Consequently, when the relay contacts do not close at the desired point, such as other than the waveform crest, large current transients, which for an inductive load may exceed 120 amps, occur. Voltage transients can result in arc destruction of the contacts.

One approach to synchronizing the switching of an A.C. power source to a load for an appliance is disclosed in U.S. Pat. No. 4,745,515 where the contacts of a relay close from the open condition at a certain point on the voltage wave cycle of the power source. The current flow through the contacts at each closing is substantially at a desired level. Control means interconnect the power source to the load through the contacts and are operable in a feedback circuit to control closure of the contacts. In the event a variation in the closure time of the contacts should occur over a period of use, the control means compensate for the change in performance of the relay by adjusting the closure time of the contacts. In this manner the closure of the contacts can be maintained at a desired point on the A.C. voltage wave cycle.

In the case of a microwave oven control when the relay operation is not synchronized on the power line waveform, current transients occur, resulting in transformer vibration which customarily is recognized by an audible noise. It is the conventional practice to utilize noise suppression devices to eliminate this problem. Such devices add additional cost and complexity to the appliance control apparatus.

Initially electromechanical relays can be synchronized with the power line waveform to open and close at intervals which prevent arcing or a spark occurring between separating contacts. The synchronization is lost as the relay contacts wear, as springs weaken, resulting in electrical arcing between separating contacts. The electrical arc causes contact material to be eroded from one contact and deposited on the mating contact. The direction of material erosion is determined by the voltage polarity of the spark. The eroded material takes the form of small cone shaped peaks on the contacts, where the contacts may eventually stick or weld together.

Electrical arcing across relay contacts generates heat. The contact material will melt, then boil, as the heat becomes excessive. Material will be transferred from one contact to another during successive switching operations. Also, splattering of molten metal occurs as contacts bounce, diminishing the area of contact.

In A.C. switching the relay contacts break load current at the same approximate point on the sine wave. The same contact is always positive and the other negative at the instant of contact separation. Material is transferred from the cathode to the anode. The amount of material transferred is dependent on the severity and duration of the arc and the type of contact material used. Thus over the cycle life of a relay contact material loss can be substantial and prevent effective operation of the appliance.

One known technique for arc suppression is the positioning of a capacitor in parallel with the contacts to prevent an arc from striking as the contacts open. As the contacts open the capacitance shunts the voltage away from the contacts; however, when the contacts close again, capacitor charge is dumped on the contacts causing an arc to strike. Therefore, to prevent charge dumping a small resistance is placed in series with the capacitor. The resistance limits capacitor current but it also reduces the effectiveness of the capacitor.

In an inductive-load application it is known to use for arc suppression a clamping device, such as a varistor, in parallel with the contacts or load. In this case, when the counter electromotive force exceeds the voltage rating of the clamp, the clamp switches from a very high to very low resistance, allowing current to flow through it. If the clamping device is to be used in A.C. applications the clamp voltage must be in excess of the peak of the highest possible expected rms voltage.

The known methods of arc suppression do not allow adjustments to be made in the operation of the electromechanical relay throughout the contact life. While contact arc suppression is known, there is further need to control the operation of a relay to extend the relay service life. By controlling the point at which the contacts break a load current, the life of the contacts can be significantly extended.

SUMMARY OF THE INVENTION

In accordance with the present invention there is provided apparatus for synchronizing the operation of an electromechanical relay with a power supply characterized by a known waveform. An electrical load receives voltage and current from the power line. A relay is positioned in series with the electrical load and the power line. The relay includes a coil and a pair of contacts movable upon actuation between an open position and a closed position to interrupt and supply power to the electrical load. Control means control the point on the power line waveform when the relay is selectively actuated to open and close the contacts to the electrical load. The control means is connected between the power supply and the relay. Voltage control means positioned between the electrical power supply and the relay supply power o the relay in a pulsed signal where the initial effective voltage potential applied across the relay control is much greater than the rated operating voltage of the coil thereby inducing a rapid current increase through the relay coil and causing rapid acceleration and subsequent closure of the contacts.

Further in accordance with the present invention there is provided power line synchronization circuitry that includes a power line connected to an electrical power supply. An electrical load receives current from the power line. A relay is positioned between the electrical load and the power line. The relay includes a coil and a pair of contacts being movable upon actuation between an open position and a closed position to interrupt and supply power to the electrical load. Control means controls the supply of voltage and current from the power supply to the relay to actuate and deactuate the relay at a predetermined point in the power line waveform. Relay coil damping means connected in parallel relation with the relay coil absorbs the energy stored in the relay coil when the control means deactuates the relay coil to prevent the occurrence of a voltage transient across the relay coil during the interval when the control means removes power from the relay coil and the relay contacts open.

Additionally, the present invention is directed to a method for controlling the opening and closing of contacts of an electromechanical relay to supply power to an electrical load at a predetermined point in the power line waveform that includes the steps of supplying an actuation signal to the relay to open and close a pair of contacts to interrupt and supply power to an electrical load. The power line waveform is monitored to determine a point in the power line waveform when the contacts are opened and closed to interrupt and supply voltage and current to the load. A pull-in time period is identified between when power is supplied to the coil of the relay and the relay contacts subsequently close at the predetermined point in the power line waveform. An increased voltage is applied to the relay coil at a predetermined point in the power line waveform to accelerate closure of contacts within the pull-in time period. Thereafter the effective voltage applied to the relay coil is reduced to a level consistent with the continuous operating condition of the relay.

Accordingly the principal object of the present invention is to provide circuitry for accurately controlling the actuation of an electromechanical relay to open and close at a preselected time in the power line waveform.

Another object of the present invention is to provide apparatus for supplying and removing electrical power to and from an electromechanical relay so that the contacts of the relay close or open at a predetermined point in the power line waveform with respect to a set reference point in the waveform.

A further object of the present invention is to provide a control system to induce a rapid energy build-up in the relay coil by pulsing a high voltage potential across the relay coil that accelerates closure of the relay contacts and then reduces the applied voltage potential to a normal continuous operating level after relay contact closure.

An additional object of the present invention is to provide method and apparatus for minimizing the transfer of material between the contacts of a relay when a relay interrupts the flow of A.C. current between the power line and a load.

These and other objects of the present invention will be more completely disclosed and described in the following specification, the accompanying drawings, and the appended claims.

DESCRIPTION OF THE PREFERRED EMBODIMENTS

Figure 1:
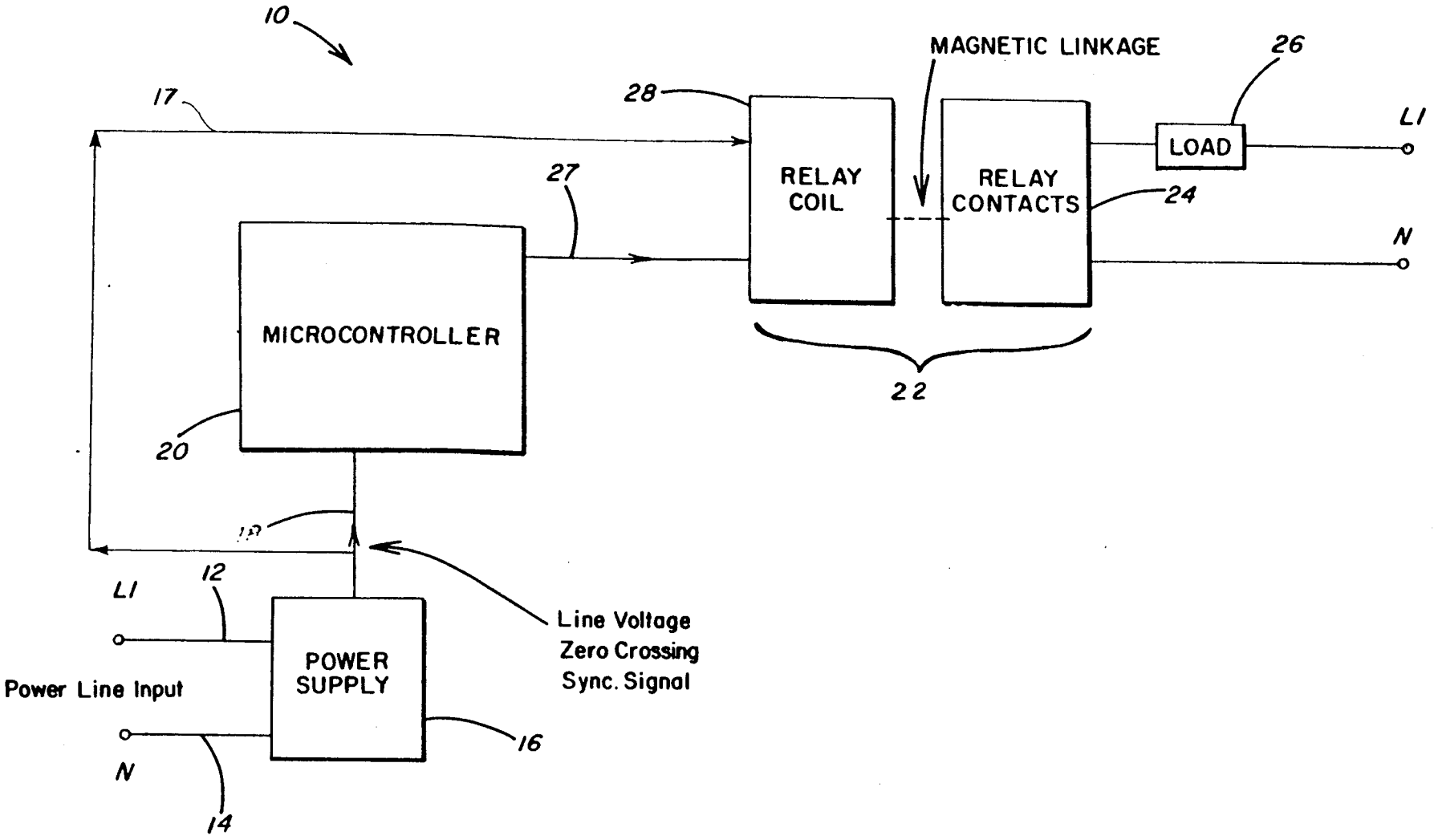
FIG. 1 is a diagrammatic illustration of a synchronized circuit for adjusting the opening and closing of relay contacts to maintain contact operation synchronized with the power line waveform.

Referring to the drawings and particularly to FIG. 1, there is diagrammatically illustrated a synchronization circuit generally designated by the numeral 10 for supplying power through power input lines 12 and 14 to a power source of an electrical apparatus, such as a transformer on a microwave oven. A power supply 16 is connected by power line 17 to an electromechanical relay 22. A signal line 18 from the power supply 16 provides an A.C. power line synchronization signal to a microcontroller 20 by which contacts 24 of the electromechanical relay 22 are opened and closed at a predetermined setpoint in the A.C. waveform. The A.C. voltage waveform is a conventional sine wave. The relay contacts 24 are switched on and off to thereby connect the A.C. line voltage to a load 26, such as the magnetron of a microwave oven. The microcontroller 20 supplies an input signal through conductor 27 to actuate a coil 28 to close the normally open contacts 24 of relay 22.

The electromechanical relay 22 includes contacts 24 which are controlled by applying power to or removing power from the relay coil 28 so that the contacts 24 open or close at a predetermined point with respect to a set reference point on the power line waveform. Closing of the relay contacts 24 is controlled by supplying power to the relay 22 in a pulsed signal where the effective voltage potential applied across the relay coil is much greater than the rated operating voltage of the coil thereby inducing a rapid current increase through the relay coil and causing rapid acceleration and subsequent closure of the relay contacts.

For a given relay construction it is possible to characterize the time interval, or pull-in time between when power is supplied to the relay coil and the subsequent relay contact closure as a constant with a defined tolerance. Some point in the time following contact closure, the effective voltage potential across the relay coil is reduced to a level consistent with the continuous operating ratings of the relay. Power is supplied to the relay coil at a predetermined point on the power line waveform. Given the initial increased voltage magnitude supplied to the relay coil, the point on the power line waveform when the relay contacts close is a fixed time period from when the power is supplied to the relay coil. Accordingly when the relay coil is to be deactuated the engergy stored in the relay coil is rapidly dissipated without inducing a voltage transient across the relay coil. By rapidly dissipating the engery in the relay coil it is possible to characterize the time interval, or drop-out time, between when the power is removed from the relay coil and the subsequent relay contact opening as a constant with a defined tolerance. Power is removed from the relay coil at a predetermined point on the power line waveform. Given the rapid dissipation of the coil energy, the point on the power line waveform when the relay contacts open is a fixed time period from when the power is removed from the relay coil.

In one example of the present invention, the relay contacts 24 are required to open near the zero point of the line current waveform. The microcontroller 20 is programmed to delay a fixed time period following the negative edge of the power line synchronization circuit output signal before turning on the initial voltage potential to relay 22. The delay is set so that the relay with the typical pull-in time will have the contacts 24 close just prior to the crest of the power line waveform. Given this turn-on delay and the known characteristics of the relay 22, the relay contacts 24 will close shortly before the power line waveform crest is reached. Also, the microcontroller 20 detects the occurrence of a line voltage zero crossing via conductor 18.

Figure 2:
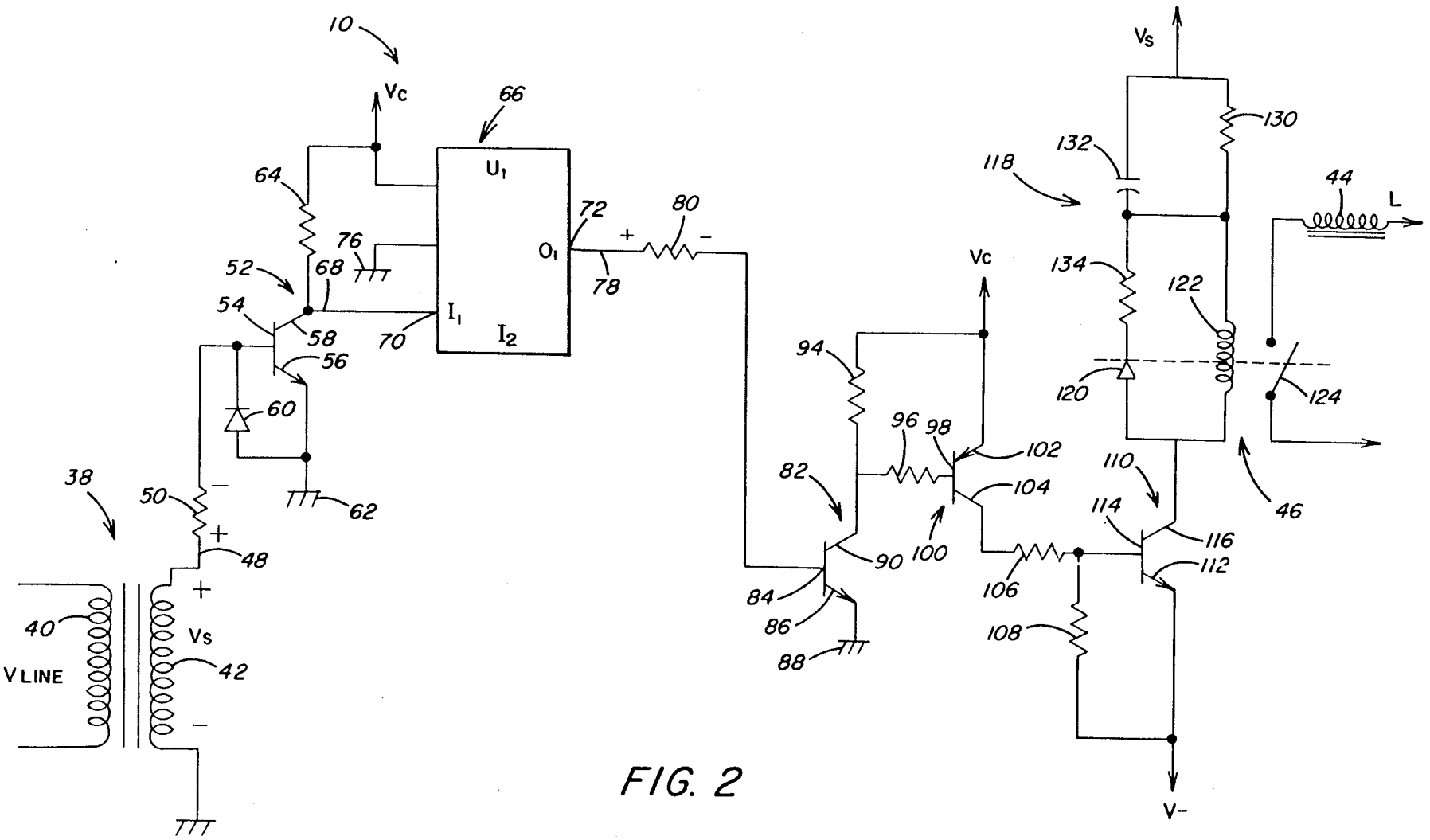
FIG. 2 is a schematic illustration corresponding to the arrangement shown in FIG. 1 for controlling the operation of an electromechanical relay connecting power to a load.

Now referring to FIG. 2, there is illustrated in greater detail the synchronization circuit diagrammatically illustrated in FIG. 1 and discussed above in which a stepdown transformer generally designated by the numeral 38 supplies power from a main power line to a primary coil 40 of the transformer 38. The main power line is the same power line that supplies power to a load 44 to be controlled by an electromechanical relay generally designated by the numeral 46 or has a known phase relationship to the power line connected to the controlled load 44. Due to the operational characteristics of a transformer, such as transformer 38, the voltage present at secondary coil 42 is proportional in amplitude and has a fixed phase relationship to the voltage waveform applied to the primary coil 40.

The transformer coil 42 is connected by conductor 48 through resistor 50 to a transistor generally designated by the numeral 52 having a base 54, emitter 56 and a collector 58. With this arrangement when voltage $V_s$ applied to the transistor base 54 is more negative than the actuation voltage of transistor 52, transistor 52 is maintained in a nonconductive state. A clamping diode 60 is connected across transistor base 54 and ground 62 and is forward biased. Current then flows through resistor 50 in a negative direction, and transistor 52 remains nonconductive.

With transistor 52 in a nonconductive state the voltage at collector 58 is near supply voltage $V_c$. As $V_s$ from the transformer coil 42 increases to a level greater than the turn-on voltage of transistor 52, transistor 52 becomes saturated causing the voltage at collector 58 to be near ground. This change in voltage of transistor collector 58 has a fixed phase relation to the power line voltage waveform via the step-down transformer 38.

The transistor collector 58 is connected through a resistor 64 to a source of supply voltage $V_c$. A microcontroller or microcomputer generally designated by the numeral 66 is also connected to supply voltage $V_c$. The microcontroller 66 monitors the voltage of transistor collector 58 for the transition in voltage from $V_c$ to the saturation voltage of transistor 52 in order to synchronize the operation of the power control relay 46 to the power line waveform. While $V_s$ is greater than the actuation voltage of clamping diode 60, diode 60 is normally maintained nonconductive. With $V_s$ being greater than the actuation voltage of transistor emitter 56, current flows in a positive direction through resistor 50 in conductor 48. The transistor collector 58 is connected by conductor 68 to input terminal 70 of microcontroller 66. Microcontroller 66 includes an output terminal 72.

The output terminal 72 of microcontroller 66 is connected by conductor 78 through resistor 80 to a transistor 82 having a base 84, emitter 86 connected to ground 88 and a collector 90. When microcontroller 66 applies supply voltage $V_c$ to output terminal 72 by its internal drive circuitry, voltage $V_c$ is greater than the voltage for actuation of transistor 82 which is normally maintained nonconductive. Positive current flows through resistor 80 and conductor 78 to base 84 of transistor 82. This results in transistor 82 entering its saturation region. At saturation transistor 82 applies current from collector 90 through conductor 92 and a pair of divider resistors 94 and 96 to base 98 of transistor 100 having emitter 102 and collector 104. Transistor 100 is normally maintained nonconductive with emitter 102 connected to supply voltage $V_c$.

The presence of an output at terminal 72 switches transistor 82 to a conductive state, to in turn switch transistor 100 to a conductive state and supplies current through resistor 106 to resistor 108 and transistor 110 which is normally maintained nonconductive with emitter 112 maintained more negative than the actuation voltage of transistor 110. Transistor base 114 is connected through collector 116 to a damping circuit generally designated by the numeral 118.

Positive current flow through resistor 106 to the base 114 of transistor 110 brings transistor 110 to its saturation stage so that a voltage potential is created across relay coil 122 of relay 46. Current through relay coil 122 induced by the voltage potential across coil 122 generates a magnetic field resulting in closure of the contacts 124 of relay 46. Contacts 124 are connected to a load represented by transformer 44 as shown in FIG. 2.

The pull-in voltage control circuit 118 as shown in FIG. 2 includes an RC network formed by resistor 130 and capacitor 132 which is connected to $V_s$. With this arrangement and no initial charge present in capacitor 132 an increased voltage potential as initially applied to coil 122 to, in turn, rapidly increase the magnetic field which causes the contacts to close more rapidly than if the rated relay voltage were only applied to coil 122. The initial voltage potential across relay coil 122 is equal to the sum of $V_s$ and V−. The voltage potential across coil 122 decays exponentially with a time constant (Tau) equal to the value of resistor 130 times the value of capacitor 132 (Tau equal R×C) as capacitor 132 gains charge until a steady state voltage potential is achieved across the relay coil 122.

The steady state coil voltage is determined by the voltage divider created between resistor 130 and coil 122 and is set by design to be approximately equal to the normal operating voltage rating for relay 46. By applying a higher voltage, for example 20 volts, across a relay coil rated for a lower voltage, for example 6 volts, the time required for the current through the coil to reach a sufficient magnitude and in turn induce sufficient force to cause the relay contact arm to close is reduced. Equally important to reducing the pull-in time of the relay, the higher initial voltage causes the timing variance from relay to relay of a given relay construction to be reduced. The effect of initial pull-in voltage on coil current increase is shown by analyzing the simplified equivalent coil drive circuit shown in FIG. 5.

Figure 5:
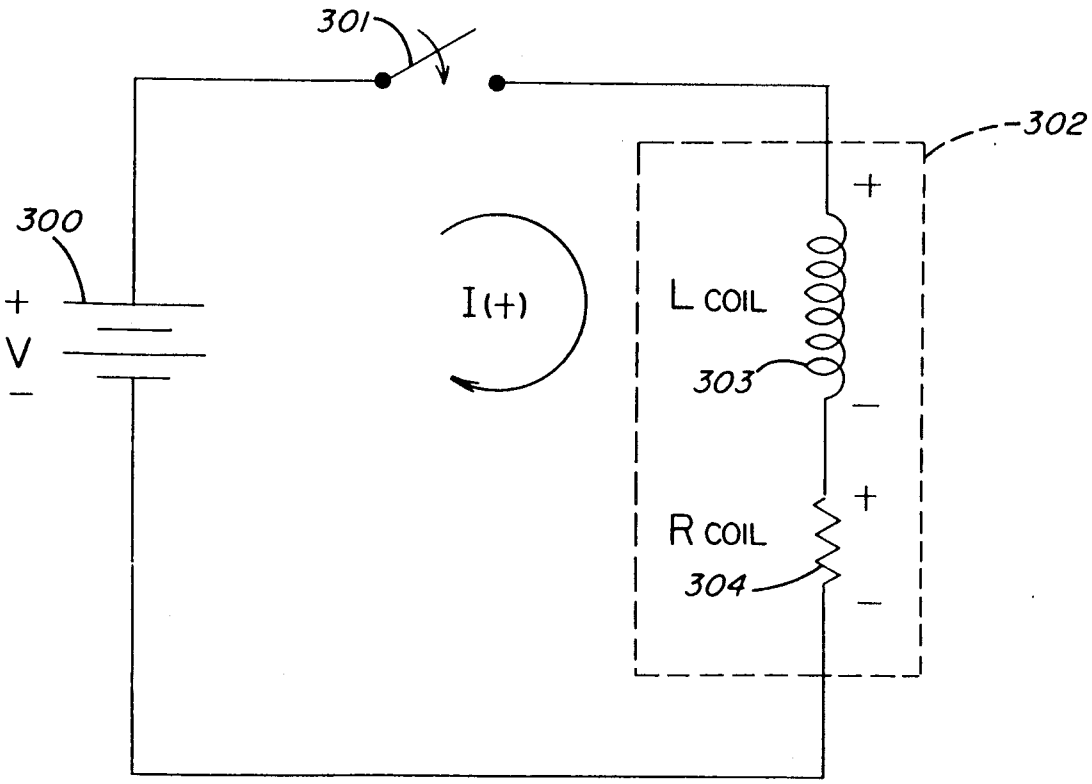
FIG. 5 is a schematic illustration of the basic coil drive circuit for effecting closure of the relay contacts.

The equivalent coil circuit 302 in FIG. 5 represents the relay coil by a series connection of inductor 303 and resistor 304. The magnitude of inductor 303 is L, and the magnitude of resistor 304 is R. Circuit 302 is connected to power supply 300 through a switching element 301. The following differential equation describes this equivalent circuit upon closure of switch 301:

$$V = L\frac{dI(t)}{dt} + RI(t) \quad (1)$$

where:

$$I(t) = I_{Final} - (I_{Final} - I_{Initial})e^{-t/\tau} \quad (2)$$

$$I(t) = V/R(1 - e^{-t/\tau}) \quad (3)$$

where:

$\tau = L/R$ $I_{Final} = V/R$ $I_{Initial} = 0$

By setting I initial and I final to the appropriate values, a specific solution to equation 1 above can be determined for time equal to or greater than 0.

Figure 6:
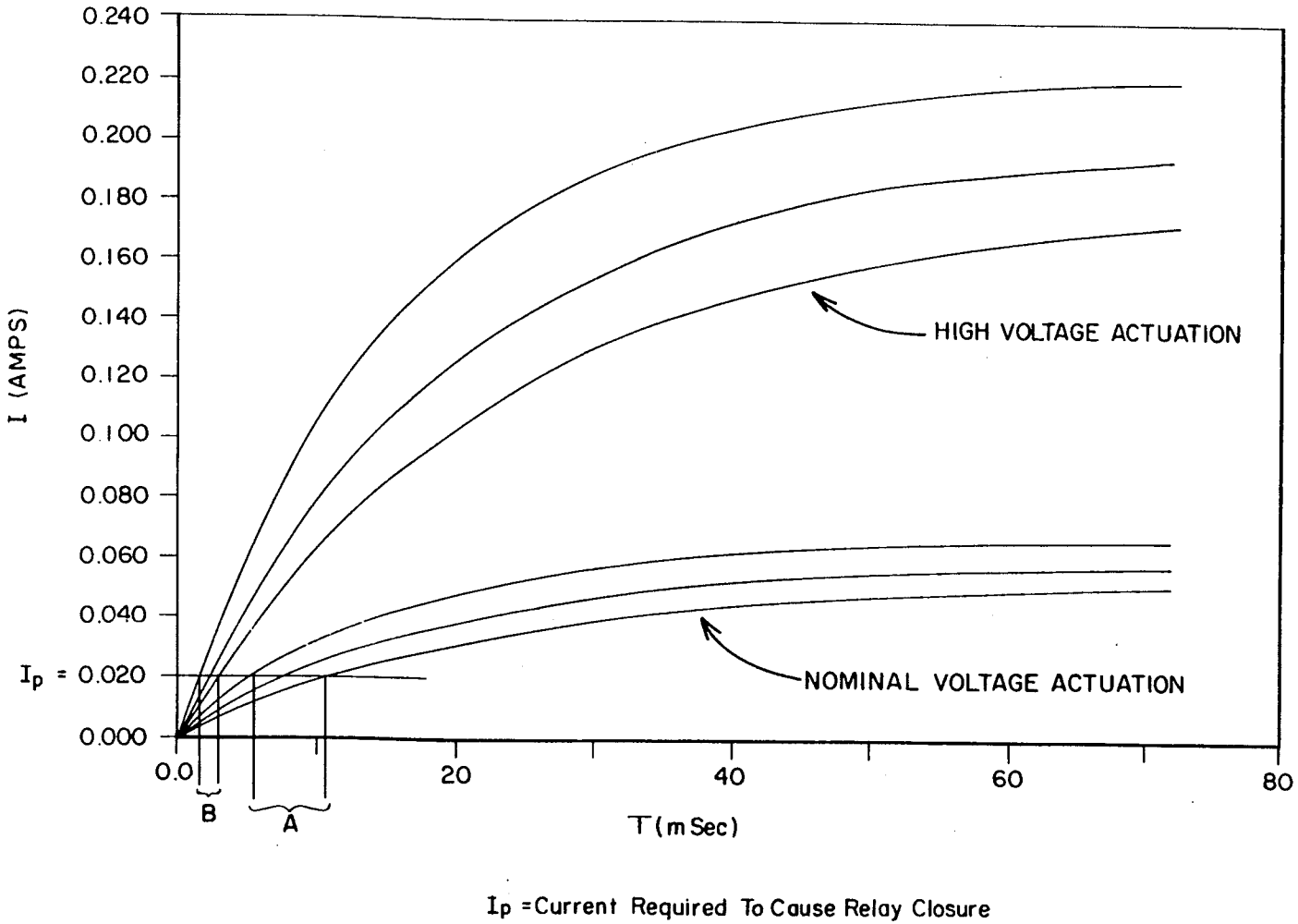
FIG. 6 is a graphic illustration of relay closure time in relation to the current required to cause relay closure.

Equation 2 above is the general resolution to Equation 1. Equation 3 represents the condition for high voltage actuation and nominal voltage actuation of the relay. The current level required to cause relay closure is designated by $I_p$ in FIG. 6 which represents Equation 3 plotted for high voltage actuation and nominal voltage actuation of the relay with relay coil inductance and resistance varied over normal relay manufacturing tolerances. When the relays are actuated by supplying nominal coil voltage, the average time required and time variance over the relay distribution for the current to build up to the level necessary for relay actuation is larger (Range A) than the corresponding time and variance for the high voltage saturation case (Range B).

As illustrated in FIG. 2, in operation the relay 46 is normally open and the transistor 110 is in a nonconductive state for an open circuit condition. To close the relay 46 the microprocessor 66 supplies an output signal to terminal 72 to switch the series connection of transistors 82, 100, and 110 to a conductive state. The damping circuit 118 is consequently closed to ground and an effective voltage, for example, 20 volts is instantaneously applied across the coil 122 for a short time interval Δ T, for example 55 milliseconds, assuring that the contacts 124 positively close without exposing the relay 46 to an otherwise excessive voltage that if applied for a greater Δ T would damage the relay 46. In this manner the relay 46 is quickly closed at the desired point on the power line waveform, as discussed above, based on actuation of the transistor 110 by the microprocessor 66.

As shown in FIG. 2 the drop-out time of the relay is controlled by the relay coil energy damping circuit 118 that includes the resistor 134 and diode 120. When transistor 110 is in saturation current flows through the relay coil 122 and no current flows through the reverse biased diode 120. Due to the inductive characteristics of the relay coil 122, the coil current switches from going through the now non-conductive transistor to going through the coil damping network causing diode 120 to become forward biased and positive current to flow through resistor 134 when the operating state of transistor 110 changes from saturation to out-off. The current flow through the relay coil 122 and damping circuit 118 decreases exponentially following cut-off of transistor 110 with a time constant approximately equal to the magnitude of the relay coil inductance divided by the sum of the damping circuit resistance and the relay coil resistance (Tau equals L/(R coil plus R 134) ).

The coil current continues to flow following turn-off of transistor 110 due to the energy stored in the relay coil inductance. This energy must be dissipated rapidly to enable characterization of given relay construction for a drop-out timing such that the timing variance from the average drop-out time is small compared to the time window within which the relay contacts are intended to open. The timing variance can be controlled by design with the proper choice of resistor 134 since the time required for the coil current to decay is directly related to the damping circuit time constant. Choosing a higher value of resistance causes the coil current to decay more rapidly and in turn reduces the drop-out time variance from relay to relay by bringing the current level in the coil below the current level required to induce enough magnetic force to maintain closure of the relay contacts. Effectively, the damping circuit 118 works to reduce the drop-out timing variance in a similar but exactly opposite manner to the initial high pull-in voltage required to reduce the pull-in timing variance.

The present invention is also further directed to a method for minimizing the transfer of material from the relay contacts as a result of the relay breaking an A.C. load current. When a load current is interrupted, the amount and direction of material transfer is affected by the load current at the contact separation, the duration of electrical arc, and the polarity of the relay contacts. The material transfer is induced by the $I^2R$ heating during breaking. As a result, the contact material is transferred from the anode contact to the cathode contact. Also, during the breaking of the load circuit, the electrical arc causes material transfer from the cathode contact to the anode contact. Thus, by controlling the maximum breaking current, the arc duration, and the polarity of the contacts during breaking, contact material transfer is greatly reduced, which in turn, extends the life expectancy of the electromechanical relay.

Figure 4:
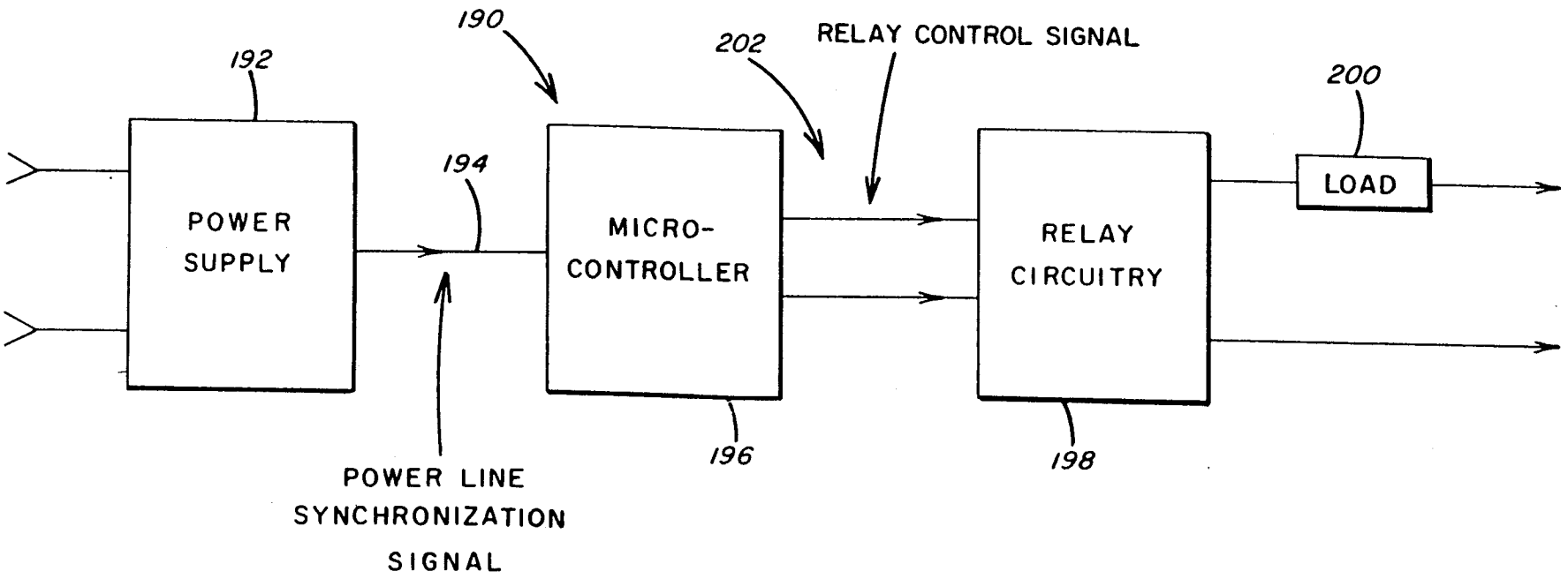
FIG. 4 is a schematic of the control circuitry for maintaining synchronization of the operation of an electromechanical relay with the power line waveform.

Now referring to FIG. 4, there is illustrated a relay synchronization circuit generally designated by the numeral 190 that includes a power supply 192 connected by a synchronization signal 194 to a microcontroller 196 which operates relay circuitry 198 that controls the supply of power to a load 200. The power supply 192 includes a control board, which in addition to supplying the necessary operating voltage potentials to the circuit 190, provides a signal through the conductor 194 to the microcontroller 196 or equivalent controlling circuitry that generates a signal which indicates the occurrence of a specific point in the line voltage waveform. Generally, the current load waveform has a defined relationship to the line voltage.

By using the defined synchronization point, the circuit 190 provides the appropriate time delay to assure that the contacts of the relay circuitry 198 will open at or closely as possible before the zero cross point in the load current waveform. By breaking the contact current at or before the zero cross point, the contact breaking current and the arc duration are minimized. This has the affect of minimizing the amount of material that is transferred between the contacts of the relay.

In addition, by using the synchronization point, the circuit 190 permits the relay contacts to alternate between opening on the positive half cycle and the negative half cycle of the load current waveform. Alternating between the positive and negative half cycles results in transfer of material back and forth between the contacts. In this manner, the net amount of material transferred from one contact to the other is maintained negligible over a large number of duty cycles of the relay circuitry 198.

Figure 3:
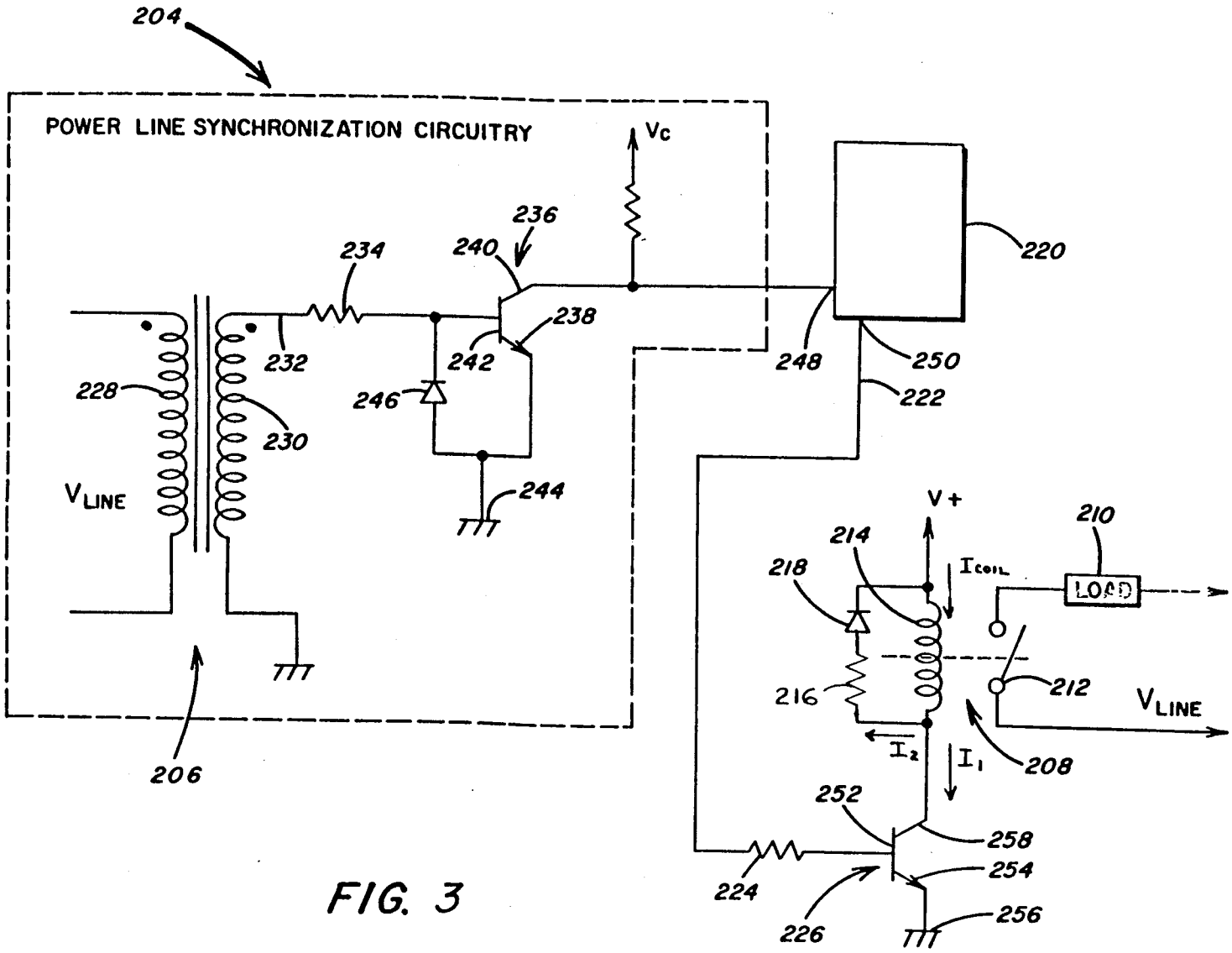
FIG. 3 is a schematic illustration of another embodiment of the present invention for opening and closing contacts of an electromechanical relay at a desired point on the power line waveform.

Now referring to FIG. 3, there is illustrated a power line synchronization circuit generally designated by the numeral 204 for synchronizing the A.C. current waveform supplied by a power source (not shown) through a step-down transformer 206 with the operation of a relay generally designated by the numeral 208 for controlling a load 210. The electromechanical relay 208 is initially characterized to determine a drop-out timing operating range. The electromechanical relay 208 includes a pair of contacts 212 and a coil 214. An energy damping circuit including resistor 216 and a diode 218 in parallel relation with coil 214 is used for coil damping to narrow the drop-out timing distribution to a preferred variation.

The relay 208 is directly connected to a power supply V+, and the relay coil 214 is switched on and off by operation of transistor 226. A microcomputer 220 is connected by conductor 222 through resistor 224 and transistor 226 to the electromechanical relay 208. Power is supplied from a source through the step-down transformer 206 that includes a primary coil 228 and a secondary coil 230. The power supplied to the transformer 206 corresponds to the power supplied to the load 210 or has known phase relationship to the power line connected to the controlled load 210. Due to the operational characteristics of the transformer 206, the voltage present at the secondary coil 230 will be proportional in amplitude and have a fixed phase relationship to the voltage waveform supplied to the primary coil 228.

The secondary coil 230 is connected by conductor 232 through resistor 234 to a transistor 236. The transistor 236 includes an emitter 238, a collector 240 and a base 242. The emitter 238 is connected to ground 244 and diode 246 is connected to the transistor base 242. When the secondary voltage of the transformer 206 is more negative than the turn-on voltage of transistor 236, the base-emitter clamping diode 246 is forward biased. Current flows through resistor 234 in a negative direction, and transistor 236 is maintained in a nonconductive state. With the transistor 236 in a nonconductive state, the voltage level at collector 240 is approximately at supply voltage $V_c$. As the voltage from the transformer 206 increases to a level greater than the turn-on voltage of transistor 236, the transistor 236 will become saturated causing the voltage level present at the collector 240 to change from $V_c$ to the saturation voltage of transistor 236. This transition of the collector voltage will have a fixed phase relationship to the line voltage waveform via the step-down transformer 206.

The microcomputer 220 monitors the voltage of the transistor collector 240 for the transition in the change in magnitude of the voltage from $V_c$ to the saturation voltage of the transistor 236, in order to synchronize operation of the power control relay 208 to the power line waveform. When the voltage of the transformer secondary coil 230 is greater than the turn-on voltage of diode 246, the diode 246 remains nonconductive. While the voltage of the secondary coil 230 is greater than the turn-on voltage of the base-emitter junction of transistor 236, current flows in a positive direction through resistor 234.

The power line sychronization circuit is connected to the microcomputer 220 at input terminal 248. The negative going edge of this signal corresponds to a specific known point on the power line voltage waveform commonly located near the negative to positive going zero crossing. Output terminal 250 of microcomputer 220 is connected to base 252 of transistor 226 through conductor 222 and resistor 224. When the output terminal 250 is at a high output voltage potential, transistor 226 enters its saturation stage and a voltage potential of V+ is applied across relay coil 214 causing current $I_1$ to flow through coil 214, collector 258 and emitter 254 to ground 256. With transistor 226 in saturation stage, diode 218 is reversed biased and current $I_2$ is equal to zero.

When output terminal 250 changes from a high output voltage to near ground, transistor 226 switches from saturation to out-of where $I_1$ is equal to zero and $I_2$ is equal to $I_{coil}$. Current $I_2$ flows in the positive direction, and diode 218 is forward biased. The required high voltage actuation of relay coil 214 is obtained by making the coil power supply voltage V+ much greater than the nominal operating voltage rating of relay coil 214. Allowing this high voltage to be continually present across relay coil 214 would cause an excessive current through coil 214 and induce excessive heating and eventual damage to relay 208. Therefore, at some time following contact closure transistor 226 is operated to limit the average current flow through relay coil 214 during continuous periods of relay closure.

By pulsing or strobing transistor 226 into and out of saturation, an effective lower voltage and, in turn, lower current through relay coil 214 can be maintained. The strobing off time of transistor 226 must be much shorter than the time required for the coil current to drop to the level required to maintain adequate magnetic force to maintain relay contact closure. Therefore, even though transistor 226 is being turned off and on, the relay 208 maintains contact closure. The effect of the longer initial transistor on time is to provide the necessary high voltage pull-in potential necessary to induce the desired relay timing characteristics in a similar manner as performed by the voltage control circuitry discussed above and disclosed in FIG. 2.

According to the provisions of the patent statutes, we have explained the principle, preferred embodiment, and mode of operation of our invention and have illustrated and described what we now consider to represent its best embodiments. However, it should be understood that, within the scope of the appended claims, the invention may be practiced otherwise than as specifically illustrated and described.

We claim:

1. Apparatus for synchronizing the operation of an electromechanical relay from a power line characterized by a known waveform comprising, an electrical load receiving voltage and current from the power line, a relay positioned in series with said electrical load and the power line, said relay including a coil and a pair of contacts being movable upon actuation between an open position and a closed position to interrupt and supply power to said electrical load, control means for selecting the point on the power line waveform when said relay is selectively actuated to open and close said contacts to said electrical load, and said control means positioned between the power line and said relay for supplying power to said relay in a pulsed signal where the initial effective voltage potential applied across said relay coil is much greater than the rated operating voltage of said coil, thereby inducing a rapid current increase through said coil and causing rapid acceleration and subsequent closure of said relay contacts.

2. Apparatus as set forth in claim 1 in which, said control means includes a microcontroller for synchronizing actuation of said relay to the power line waveform.

3. Apparatus as set forth in claim 1 in which, said control means at a predetermined time following contact closure reduces the effective voltage potential across said relay coil to a level consistent with the continuous operating ratings of said relay.

4. Apparatus as set forth in claim 1 which includes, damping means connected in parallel relation with said relay coil for absorbing the energy stored in said relay coil when said control means deactuates said relay coil to prevent the occurrence of a voltage transient across said relay coil during the interval when said control means removes power from said relay coil and said relay contacts open.

5. Apparatus as set forth in claim 4 in which, said damping means includes a series connection of a resistor and a diode positioned across said relay coil where current flow through said resistor and diode from said relay coil decreases exponentially to bring the current through said relay coil below the current level required to induce the magnetic force to maintain closure of said relay contacts.

6. Power line synchronization circuitry comprising, an electrical power supply connectable to a power line an electrical load for receiving current from said power line, a relay positioned between said electrical load and said power line, said relay including a coil and a pair of contacts being movable upon actuation between an open position and a closed position to interrupt and supply power to said electrical load, control means for controlling the supply of voltage and current from said power supply to said relay to actuate and deactuate said relay at a preselected point in the power line waveform, said control means positioned between the power line and said relay for supplying power to said relay in a pulsed signal where the initial effective voltage potential applied across said relay coil is much greater than the rated operating voltage of said coil, and relay coil damping means connected in parallel relation with said relay coil for absorbing the energy stored in said relay coil when said control means deactuates said relay coil to prevent the occurrence of a voltage transient across said relay coil during the interval when said control means removes power from said relay coil and said relay contacts open.

7. Power line synchronization circuitry as set forth in claim 6 which includes, a transistor positioned in the circuitry between said control means and said relay coil damping means, said transistor being normally maintained nonconductive to prevent actuation of said relay, and said transistor being switched from a nonconductive state to a conductive state when the voltage applied to said control means for actuation of said relay is synchronized with the power line waveform

8. Power line synchronization circuitry as set forth in claim 7 in which, said relay coil damping means is closed to ground when said transistor is switched to a conductive state.

9. Power line synchronization circuitry as set forth in claim 7 in which, said transistor is switched to a nonconductive state to direct current from said relay coil to said relay coil damping means and thereby dissipate the energy stored in said relay coil below the energy level required to maintain closure of said relay contacts.

10. Power line synchronization circuitry as set forth in claim 9 in which said relay coil damping means includes means for controlling the drop-out time within which said relay contacts open.

11. A method for controlling the opening and closing of contacts of an electromechanical relay to supply power to an electrical load at a predetermined point in a power line waveform comprising the steps of, supplying an actuation signal to the relay to open and close a pair of contacts to interrupt and supply power to said electrical load, monitoring the power line waveform to determine a point in the power line waveform when the contacts are opened and closed to interrupt and supply voltage and current said electrical load, identifying a pull-in time period between when power is supplied to the coil of the relay and the subsequent relay contacts closure at the predetermined point in the power line waveform, applying an increased voltage to the relay coil at a predetermined point in the power line waveform to accelerate closure of the contacts within the pull-in time period, and thereafter reducing the effective voltage applied to the relay coil to a level consistent with the continuous operating condition of the relay.

12. Apparatus for synchronizing the operation of an electromechanical relay from a power line characterized by a known waveform comprising, an electrical load receiving voltage and current from the power line, a relay positioned in series with said electrical load and the power line, said relay including a coil and a pair of contacts being movable upon actuation between an open position and a closed position to interrupt and supply power to said electrical load, control means for selecting the point on the power line waveform when said relay is selectively actuated to open and close said contacts to said electrical load, said control means positioned between the power line and said relay for supplying power to said relay in a pulsed signal where the initial effective voltage potential applied across said relay coil is much greater than the rated operating voltage of said coil thereby inducing a rapid current increase through said coil and causing rapid acceleration and subsequent closure of said relay contacts, said control means supplies a signal to said relay to close said contacts at the crest of the power line waveform, and said control means detecting the interval of time between when power is supplied to said relay coil and the subsequent relay contact closure.

13. Apparatus for synchronizing the operation of an electromechanical relay from a power line characterized by a known waveform comprising, an electrical load receiving voltage and current from the power line, a relay positioned in series with said electrical load and the power line, said relay including a coil and a pair of contacts being movable upon actuation between an open position and a closed position to interrupt and supply power to said electrical load, control means for selecting the point on the power line waveform when said relay is selectively actuated to open and close said contacts to said electrical load, said control means positioned between the power line and said relay for supplying power to said relay in a pulsed signal where the initial effective voltage potential applied across said relay coil is much greater than the rated operating voltage of said coil thereby inducing a rapid current increase through said coil and causing rapid acceleration and subsequent closure of said relay contacts, and said control means supplies power to said relay coil at a predetermined point on the power line waveform at an initial increased voltage magnitude to close said relay contacts in a fixed time period.

14. Apparatus for synchronizing the operation of an electromechanical relay from a power line characterized by a known waveform comprising, an electrical load receiving voltage and current from the power line, a relay positioned in series with said electrical load and the power line, said relay including a coil and a pair of contacts being movable upon actuation between an open position and a closed position to interrupt and supply power to said electrical load, control means for selecting the point on the power line waveform when said relay is selectively actuated to open and close said contacts to said electrical load, said control means positioned between the power line and said relay for supplying power to said relay in a pulsed signal where the initial effective voltage potential applied across said relay coil is much greater than the rated operating voltage of said coil thereby inducing a rapid current increase through said coil and causing rapid acceleration and subsequent closure of said relay contacts, and a pull-in voltage control circuit positioned between said control means and said relay coil for applying an increasing voltage potential to said relay coil to rapidly increase the magnetic field to close more rapidly said relay contacts than if the rated voltage were only applied to said relay coil.

15. A method for controlling the opening and closing of contacts of an electromechanical relay to supply power to an electrical load at a predetermined point in the power line waveform comprising the steps of, supplying an actuation signal to the relay to open and close a pair of contacts to interrupt and supply power to an electrical load, monitoring the power line waveform to determine a point in the power line waveform when the contacts are opened and closed to interrupt and supply voltage and current to the load, identifying a pull-in time period between when power is supplied to the coil of the relay and the subsequent relay contacts closure at the predetermined point in the power line waveform, applying an increased voltage to the relay coil at a predetermined point in the power line waveform to accelerate closure of the contacts within the pull-in time period, thereafter reducing the effective voltage applied to the relay coil to a level consistent with the continuous operating condition of the relay, and further including, identifying the time delay in closing the contacts of a relay after current is applied to the coil of the relay, and supplying current to the relay coil so that after passage of the time delay the relay contacts close before the zero cross point in the load current waveform.

16. A method as set forth in claim 15 which includes, alternating the opening and closing of the relay contacts on the positive half cycle and the negative half cycle of the load current waveform.

17. A method as set forth in claim 15 which includes, pulsing a transistor into and out of saturation to increase the current to the coil of the relay to maintain closure of the relay contacts without subjecting the relay coil to a current level greater than the rated current of the relay coil.

18. A method as set forth in claim 15 which includes, limiting the average current flow through the relay coil at a preselected time following closure of the relay contacts for the period of continuous relay closure.

* * * * *

UNITED STATES PATENT AND TRADEMARK OFFICE

CERTIFICATE OF CORRECTION

PATENT NO. : 5,055,962

DATED : October 8, 1991

INVENTOR(S) : Gregory A. Peterson, Timothy Graff

It is certified that error appears in the above-identified patent and that said Letters Patent is hereby corrected as shown below:

Column 3, line 20, change "o" to --to--.

Column 8, line 10, change "55" to --5--.

Signed and Sealed this

Sixteenth Day of March, 1993

*Attest:*

STEPHEN G. KUNIN

*Attesting Officer*

*Acting Commissioner of Patents and Trademarks*